US007398559B2

(12) United States Patent
Flatt

(10) Patent No.: US 7,398,559 B2
(45) Date of Patent: Jul. 15, 2008

(54) PERSPIRATION REDIRECTING HEAD BAND DEVICE

(75) Inventor: Erick P. Flatt, Dallas, TX (US)

(73) Assignee: GUTR, Inc., Dallas, TX (US)

( * ) Notice: Subject to any disclaimer, the term of this patent is extended or adjusted under 35 U.S.C. 154(b) by 0 days.

(21) Appl. No.: 11/545,333

(22) Filed: Oct. 10, 2006

(65) Prior Publication Data

US 2007/0079423 A1 Apr. 12, 2007

Related U.S. Application Data

(60) Provisional application No. 60/725,492, filed on Oct. 11, 2005.

(51) Int. Cl.
*A42C 5/00* (2006.01)

(52) U.S. Cl. ..... 2/181; 2/174

(58) Field of Classification Search ..... 2/162, 2/170, 171, 174, 181, 181.2, 181.4, 181.6, 2/181.8, 182.1, 182.2, 182.3, 182.4, 182.5, 2/182.6, 182.7, 182.8; 132/212
See application file for complete search history.

(56) References Cited

U.S. PATENT DOCUMENTS

| | | | | | |
|---|---|---|---|---|---|
| 1,750,937 | A | | 3/1930 | Morgan | |
| 2,320,782 | A | | 6/1943 | Larsen | |
| 4,368,545 | A | | 1/1983 | Seidman | |
| 4,481,680 | A | * | 11/1984 | Mason et al. | 2/174 |
| 4,626,247 | A | | 12/1986 | Frankel | |
| 4,638,512 | A | | 1/1987 | Frankel | |
| 5,073,989 | A | | 12/1991 | Teague | |
| 5,113,533 | A | * | 5/1992 | Takada | 2/170 |
| 5,146,630 | A | | 9/1992 | Richard | |
| 5,175,887 | A | | 1/1993 | Kim | |
| 5,590,422 | A | | 1/1997 | Henderson | |
| 5,600,854 | A | | 2/1997 | Henrekin | |
| 5,740,556 | A | | 4/1998 | Brown | |
| 5,781,932 | A | | 7/1998 | Brown | |
| 5,901,381 | A | | 5/1999 | Nelson | |
| 5,926,849 | A | | 7/1999 | Boyle | |
| 6,272,691 | B1 | * | 8/2001 | Henricksen et al. | 2/338 |
| 6,353,936 | B2 | | 3/2002 | Flatt | |
| 6,584,984 | B2 | * | 7/2003 | Kelly | 132/212 |
| 6,971,122 | B2 | * | 12/2005 | Sanchez | 2/181.6 |
| 2001/0047536 | A1 | * | 12/2001 | Flatt | 2/181 |
| 2004/0139533 | A1 | * | 7/2004 | Kurpis | 2/468 |

* cited by examiner

*Primary Examiner*—Katherine Moran
*Assistant Examiner*—Sally C Cline
(74) *Attorney, Agent, or Firm*—Scott T. Griggs; Griggs Bergen LLP

(57) ABSTRACT

A head band device for protecting a wearer's eyes from perspiration from the wearer's forehead is provided. A substantially nonabsorbent band includes a front band portion and two side band portions. The gutter structure extends from an outer surface of the band. The gutter structure includes a gutter base and a gutter lip. The gutter structure in combination with the front band portion and at least part of the first and second side band portions forms a perspiration channel with a generally U-shaped cross-section. The gutter base has a first thickness at a central portion thereof. The gutter base has a second thickness at end portions thereof. The first thickness is greater than the second thickness. The gutter base slopes from the central portion downward toward the end portions thereof, transitioning from the first thickness to the second thickness. A closure system has two fasteners and an elastic loop member.

23 Claims, 12 Drawing Sheets

PERSPIRATION REDIRECTING HEAD BAND DEVICE

This application claims the benefit of U.S. Provisional Application No. 60/725,492, filed on Oct. 11, 2005, entitled PERSPIRATION REDIRECTING HEAD BAND DEVICE, which application is hereby incorporated herein by reference.

TECHNICAL FIELD

The present invention generally relates to head bands. In one aspect it relates more particularly to a head band capable of redirecting a flow of perspiration.

BACKGROUND

When a person perspires, the perspiration from one's forehead flows downward and often flows into one's eyes. To overcome this problem numerous head bands are known which absorb the perspiration on the forehead before it can flow into one's eyes. In this respect, throughout the years, a number of innovations have been developed relating to perspiration absorbent head bands, and the following U.S. patents are representative of some of those innovations: U.S. Pat. Nos. 5,073,989, 5,590,422, 5,901,381, and 5,926,849. One problem associated with any head band that absorbs perspiration is the problem of saturation. When the head band becomes saturated with perspiration, it can no longer absorb perspiration. As a result, either the wearer must take the head band off and squeeze out the absorbed perspiration, or excess perspiration will flow out from the saturated absorbent. Hence, these is a need for a head band that prevents sweat from getting in one's eyes, even after a long period of time when conventional head bands would be saturated and dripping perspiration into one's eyes.

SUMMARY OF THE INVENTION

The problems and needs outlined above may be addressed by embodiments of the present invention. In accordance with one aspect of the present invention, which will be summarized in this paragraph, a head band device for protecting a wearer's eyes from perspiration from the wearer's forehead, is provided. The head band device includes a substantially nonabsorbent band and a gutter structure. The substantially nonabsorbent band includes a front band portion, a first side band portion, and a second side band portion. The gutter structure extends from an outer surface of the band. The gutter structure includes a gutter base and a gutter lip. The gutter base and the gutter lip are substantially nonabsorbent. The gutter structure in combination with the front band portion and at least part of the first and second side band portions forms a perspiration channel with a generally U-shaped cross-section. The gutter structure is continuous as it extends beginning from the first side band portion, entirely along the front band portion, and terminating to the second side band portion. The gutter base has a first thickness at a central portion thereof. The gutter base has a second thickness at end portions thereof. The first thickness is greater than the second thickness. The gutter base slopes from the central portion downward toward the end portions thereof, transitioning from the first thickness to the second thickness.

This paragraph describes some illustrative variations upon the aspect described in the immediately preceding paragraph. The gutter base and the gutter lip may be integrally formed with the band from a same PVC material. A top edge of the band, at least above the gutter structure, may be sloped downward toward the gutter structure. The band may further include a first rear band portion and a second rear band portion, wherein the head band device further comprises a closure system, the closure system comprising an elastic loop member, a first hook-and-loop fastener, and a second hook-and-loop fastener, the first hook-and-loop fastener being attached to the first rear band portion, such that the first rear band portion is folded on itself with the first hook-and-loop fastener located there between when the first hook-and-loop fastener is in a closed configuration, the second hook-and-loop fastener being attached to the second rear band portion, such that the second rear band portion is folded on itself with the second hook-and-loop fastener located there between when the second hook-and-loop fastener is in a closed configuration, in an operable configuration, the first rear band portion being threaded through the elastic loop member when the first hook-and-loop fastener is in its closed configuration, in the operable configuration, the second rear band portion also being threaded through the elastic loop member when the second hook-and-loop fastener is in its closed configuration, and in the operable configuration, the band forms a loop structure via the elastic loop member. The head band device may further include: a first fastener attached to an end region of the first side band portion; and a second fastener attached to an end region of the second side band portion, wherein the first and second fasteners are configured to removably attach to a hat, a helmet, eyewear, or any combination thereof in an interchangeable manner. Each of the side band portions may have one or more holes formed therein, and the holes may be located at a spaced distance from the gutter structure along the band. The head band device may further include an absorbent material attached to the gutter structure and may be located at least partially in and/or over the perspiration channel. The gutter lip may curve toward the outer surface of the band. The gutter lip may curves toward the outer surface of the band and then downward toward the gutter base. The gutter lip may terminate with a non-rounded inner edge. A top edge of the band, at least above the gutter structure, may be curved downward toward the gutter structure. A top edge of the band, at least above the gutter structure, may have a generally rounded cross-section shape.

In accordance with another aspect of the present invention, which will be summarized in this paragraph, a head band device for protecting a wearer's eyes from perspiration from the wearer's forehead, is provided. The head band device includes a substantially nonabsorbent band, a gutter structure, and a closure system. The substantially nonabsorbent band includes a front band portion, a first side band portion, a second side band portion, a first rear band portion, and a second rear band portion. A gutter structure extends from an outer surface of the band. The gutter structure includes a gutter base and a gutter lip. The gutter base and the gutter lip being substantially nonabsorbent. The gutter structure in combination with the front band portion and at least part of the first and second side band portions forms a perspiration channel with a generally U-shaped cross-section. The gutter structure is continuous as it extends beginning from the first side band portion, entirely along the front band portion, and terminating to the second side band portion. The closure system includes an elastic loop member, a first hook-and-loop fastener, and a second hook-and-loop fastener. The first hook-and-loop fastener is attached to the first rear band portion, such that the first rear band portion is folded on itself with the first hook-and-loop fastener located there between when the first hook-and-loop fastener is in a closed configuration. The second hook-and-loop fastener is attached to the second rear band portion, such that the second rear band portion is folded on itself with the second hook-and-loop fastener located there between when the second hook-and-loop fastener is in a closed configuration. In an operable configuration, the first rear band portion is threaded through the elastic loop member when the first hook-and-loop fastener is in its closed configuration. In the operable configuration, the second rear band portion also is threaded through the elastic loop member when the second hook-and-loop fastener is in its closed configuration. In the operable configuration, the band forms a loop structure via the elastic loop member.

This paragraph describes some illustrative variations upon the aspect described in the immediately preceding paragraph. The gutter base may have a first thickness at a central portion thereof, the gutter base may have a second thickness at end portions thereof, the first thickness may be greater than the second thickness, and the gutter base may slope from the central portion downward toward the end portions thereof, transitioning from the first thickness to the second thickness. The gutter base and the gutter lip may be integrally formed with the band from a same PVC material. A top edge of the band, at least above the gutter structure, may be sloped downward toward the gutter structure. Each of the side band portions may have one or more holes formed therein, and the holes may be located at a spaced distance from the gutter structure along the band. The head band device may further include an absorbent material attached to the gutter structure and located at least partially in and/or over the perspiration channel. The gutter lip may curve toward the outer surface of the band. The gutter lip may curves toward the outer surface of the band and then downward toward the gutter base. The gutter lip may terminate with a non-rounded inner edge. A top edge of the band, at least above the gutter structure, may be curved downward toward the gutter structure. A top edge of the band, at least above the gutter structure, may have a generally rounded cross-section shape.

In accordance with yet another aspect of the present invention, which will be summarized in this paragraph, a head band device for protecting a wearer's eyes from perspiration from the wearer's forehead, is provided. The head band device includes a substantially imperforate and nonabsorbent band, a gutter structure, a first fastener, and a second fastener. The substantially imperforate and nonabsorbent band includes a front band portion, a first side band portion, and a second side band portion. A gutter structure extends from an outer surface of the band. The gutter structure includes a gutter base and a gutter lip. The gutter base and the gutter lip are substantially imperforate and nonabsorbent. The gutter structure in combination with the front band portion and at least part of the first and second side band portions form a perspiration channel with a generally U-shaped cross-section. The gutter structure is continuous as it extends beginning from the first side band portion, entirely along the front band portion, and terminating to the second side band portion. The first fastener is attached to an end region of the first side band portion. The second fastener is attached to an end region of the second side band portion, wherein the first and second fasteners are configured to removably attach to a hat, a helmet, eyewear, or any combination thereof in an interchangeable manner.

This paragraph describes some illustrative variations upon the aspect described in the immediately preceding paragraph. The gutter base may have a first thickness at a central portion thereof, the gutter base may have a second thickness at end portions thereof, the first thickness may be greater than the second thickness, and the gutter base may slope from the central portion downward toward the end portions thereof, transitioning from the first thickness to the second thickness. The gutter base and the gutter lip may be integrally formed with the band from a same PVC material. A top edge of the band, at least above the gutter structure, may be sloped downward toward the gutter structure. Each of the side band portions may have one or more holes formed therein, the holes being located at a spaced distance from the gutter structure along the band. The head band device may further include an absorbent material attached to the gutter structure and located at least partially in and/or over the perspiration channel. The first and second fasteners may include a fastener member, such as a loop portion of a hook-and-loop fastener, a hook portion of a hook-and-loop fastener, a snap, a clasp, a button, a button hole, a zipper, a latch, a buckle, a buckle hole, a clip, a magnet, a screw, a bolt, a nut, or combinations thereof, for example. The gutter lip may curve toward the outer surface of the band. The gutter lip may curves toward the outer surface of the band and then downward toward the gutter base. The gutter lip may terminate with a non-rounded inner edge. A top edge of the band, at least above the gutter structure, may be curved downward toward the gutter structure. A top edge of the band, at least above the gutter structure, may have a generally rounded cross-section shape.

The foregoing has outlined rather broadly features of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The following is a brief description of the drawings, which illustrate exemplary embodiments of the present invention and in which.

DETAILED DESCRIPTION OF ILLUSTRATIVE EMBODIMENTS

Figure 1:
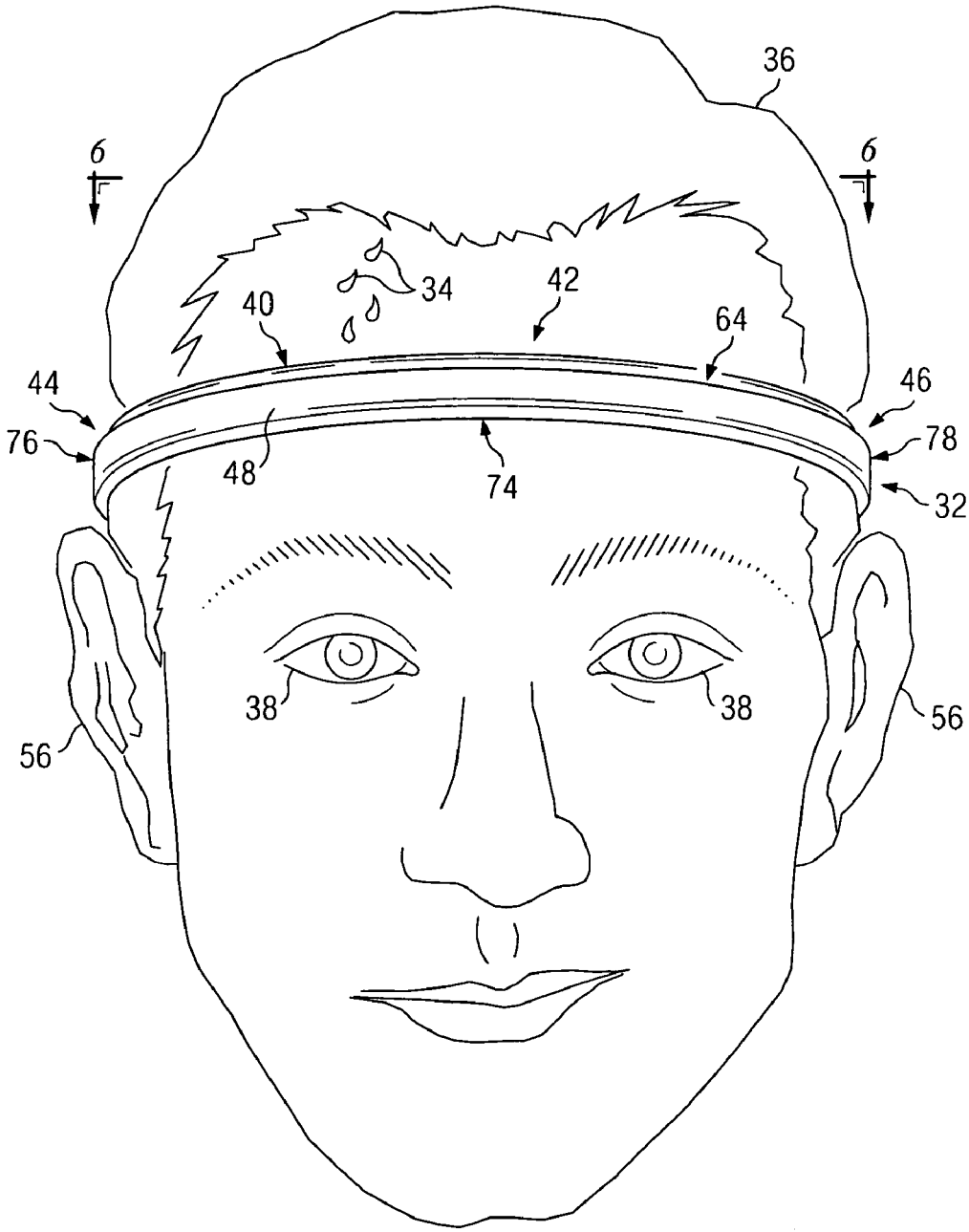
FIG. 1 shows a front view of a placement option for the first embodiment of the head band device.

Referring now to the drawings, wherein like reference numbers are used herein to designate like or similar elements throughout the various views, illustrative embodiments of the present invention are shown and described. The figures are not necessarily drawn to scale, and in some instances the drawings have been exaggerated and/or simplified in places for illustrative purposes only. One of ordinary skill in the art will appreciate the many possible applications and variations of the present invention based on the following illustrative embodiments of the present invention. The inventor's patent, U.S. Pat. No. 6,353,936, is hereby incorporated by reference in its entirety.

Figure 10:
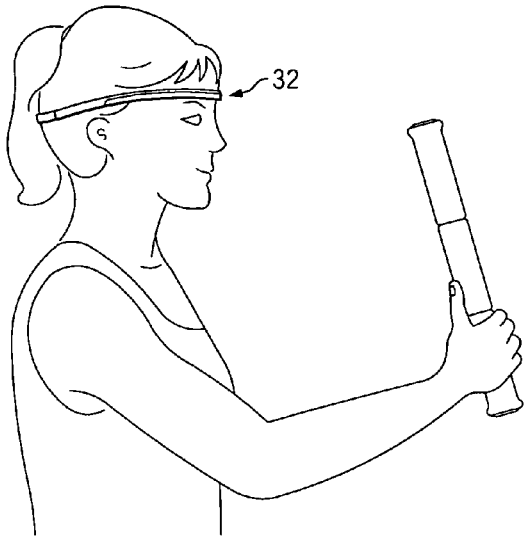
FIGS. 10-12 show some illustrative examples of how the first embodiment may be utilized.
Figure 11:
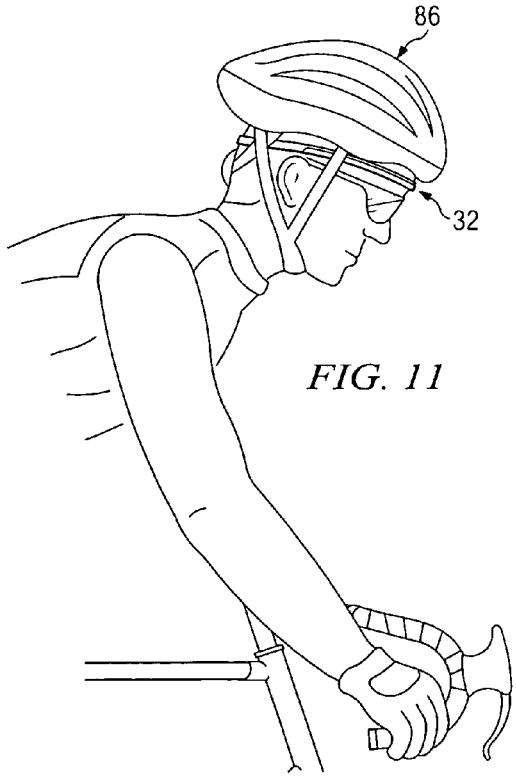
Figure 12:
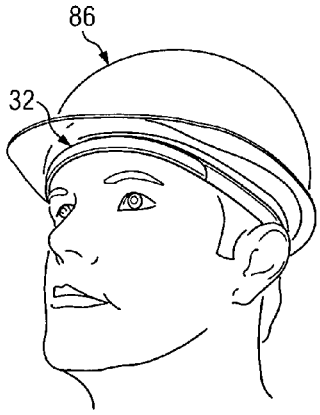

Generally, an embodiment of the present invention provides a head band device 32 designed to redirect perspiration flowing from a person's forehead 36 away from a person's eyes 38 (off to the side). FIGS. 1-12 show a head band device 32 in accordance with a first illustrative embodiment of the present invention. FIGS. 10-12 show some illustrative examples of how the first embodiment may be utilized. FIG. 13-18 show additional illustrative embodiments of the present invention. FIGS. 19-30 show additional features that may be incorporated into any embodiment of the present invention. The device 32 of the first illustrative embodiment will be described, and then other illustrative embodiments and examples will be described.

Referring now to FIGS. 1-12, the head band device 32 of the first illustrative embodiment includes a nonabsorbent band 40, which has front band portion 42, a first side band portion 44, a second side band portion 46, a sloping front gutter structure 48, and a rear band portion 50, 52 with a closure system 54. Preferably, the head band device 32 is a single molded piece of PVC material. However in other embodiments, the head band device 32 may be made of multiple pieces that are attached or glued together. The band 40 of an embodiment may be made from any suitable material, including (but not limited to): PVC, latex, rubber, plastic, thermoplastic elastomers (e.g., Santoprene™), and combinations thereof, for example. Preferably, the band 40 of an embodiment is made from a nonabsorbent material.

Figure 2:
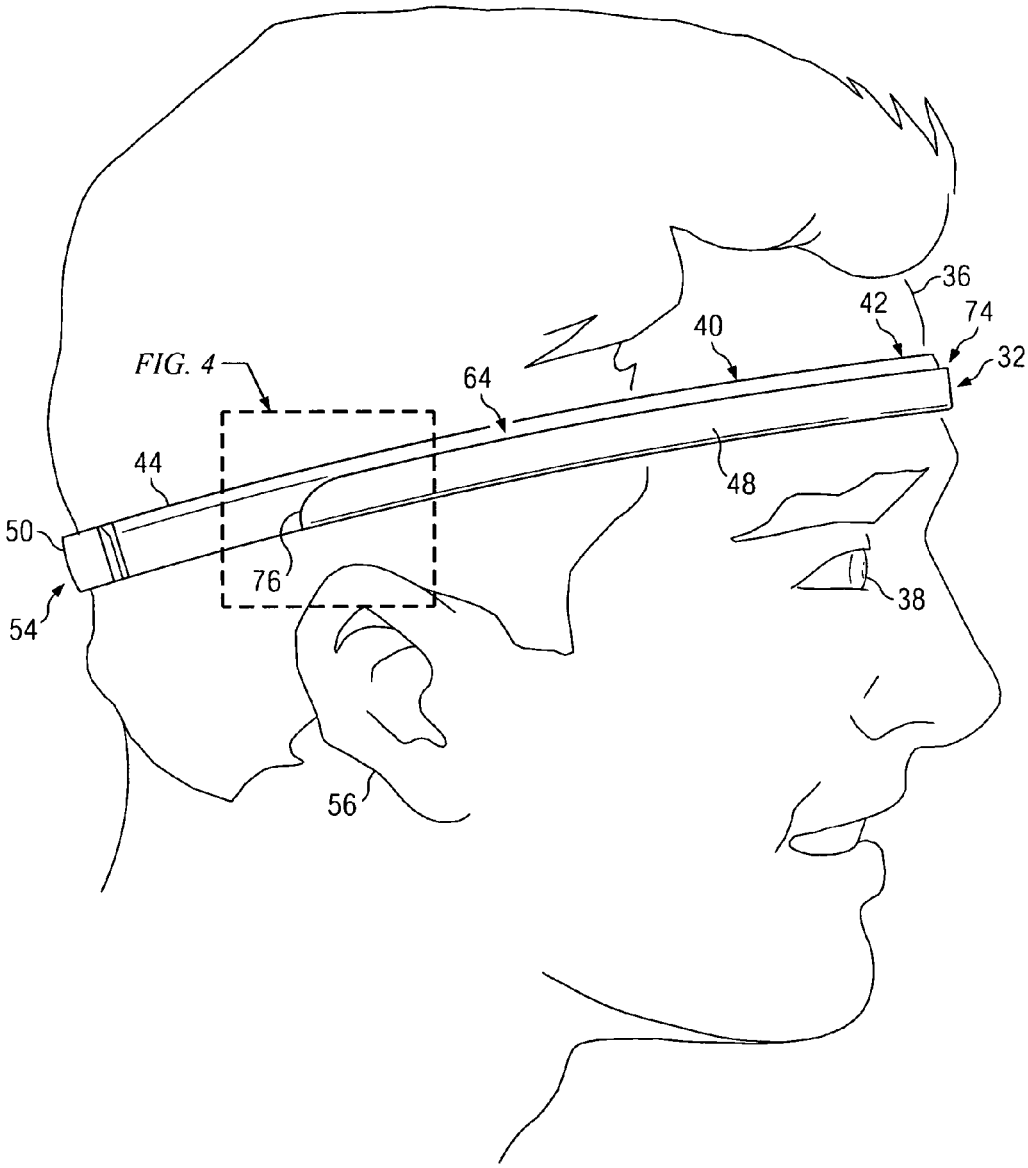
FIG. 2 shows the side view of the first embodiment of the head band device as it may be worn on the wearer's head.
Figure 3:
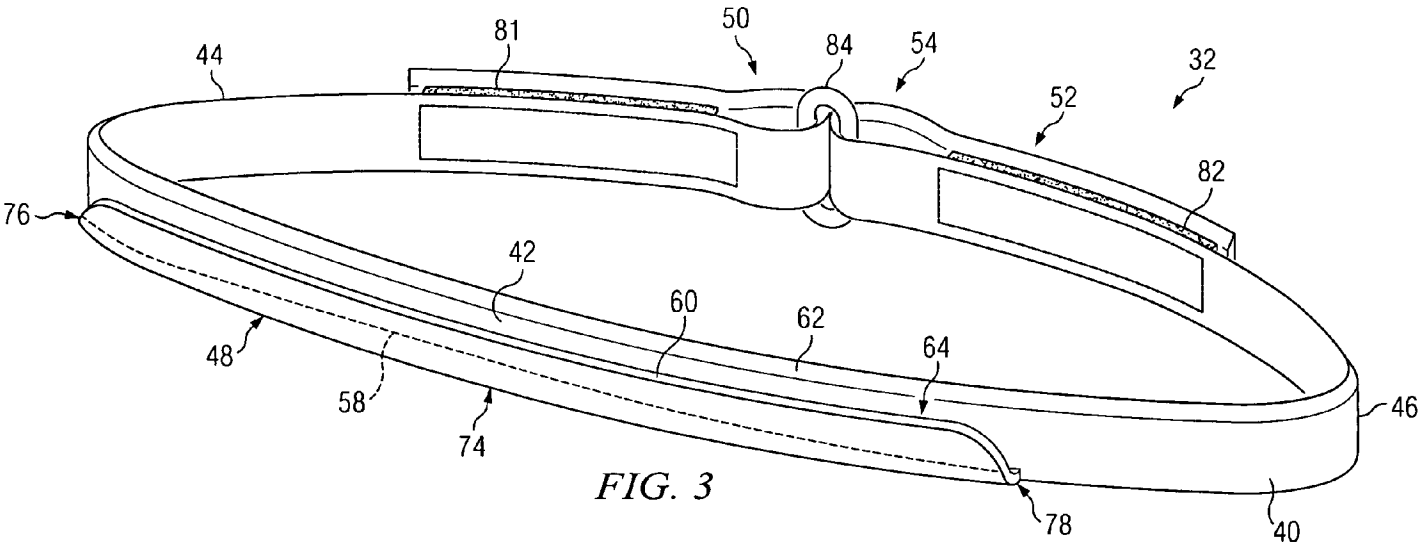
FIG. 3 is perspective view of the first embodiment.
Figure 4:
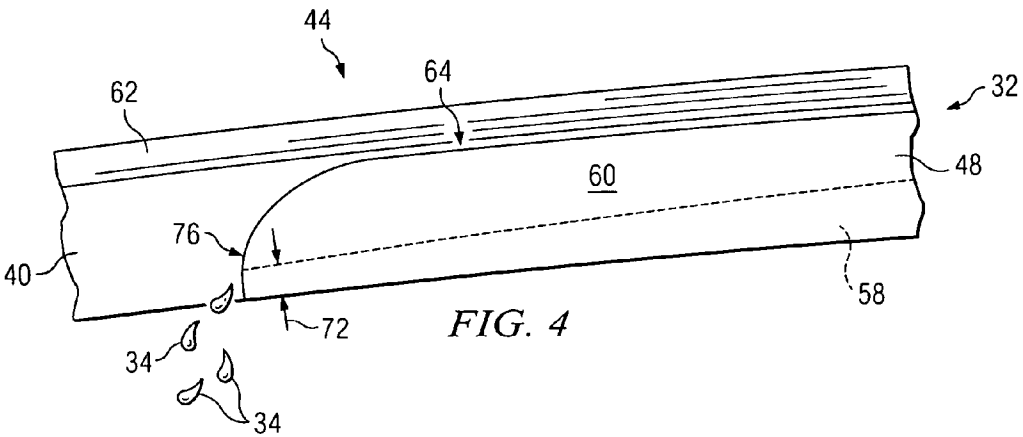
FIG. 4 is an enlarged view illustrating the draining effect of the sloping gutter structure at the first side of the head band device from FIG. 2.
Figure 5:
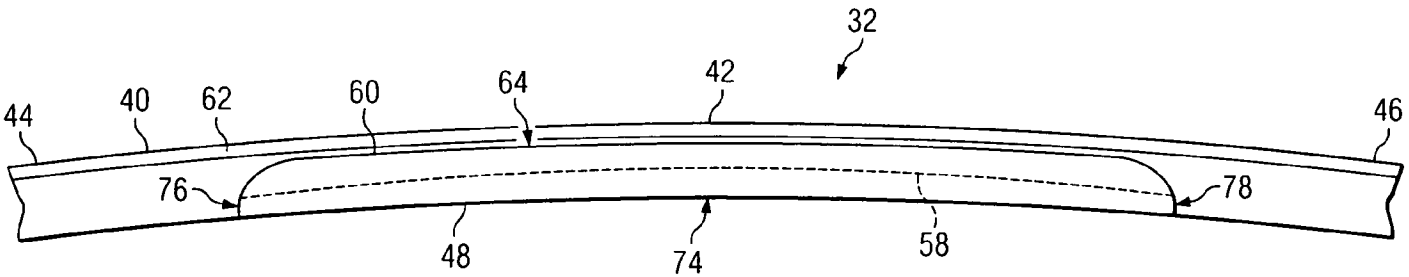
FIG. 5 is a front view showing a front portion of the head band device.
Figure 6:
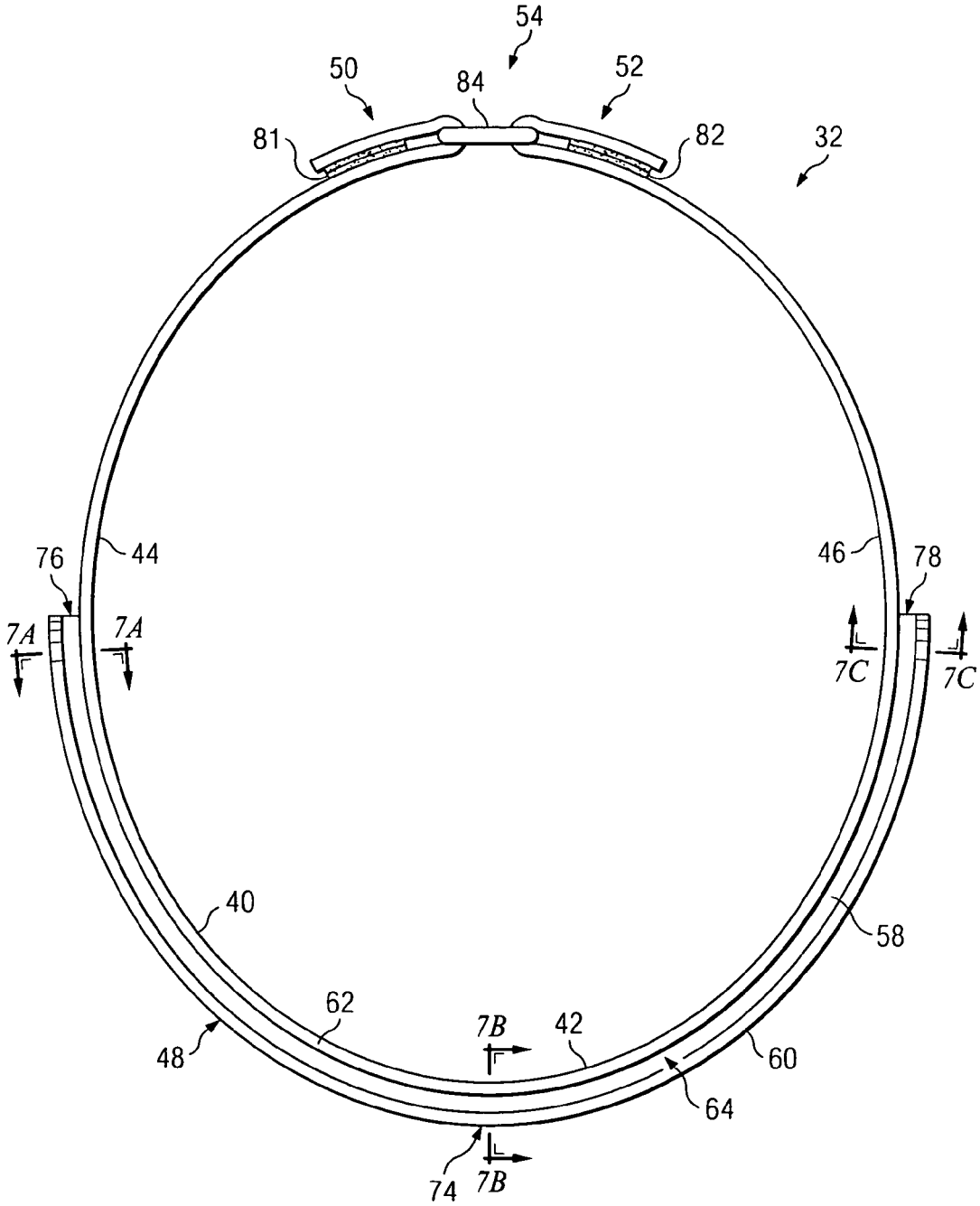
FIG. 6 is a top view of the first embodiment shown in FIG. 1 as taken along line 6-6.

FIG. 1 shows a front view of a placement option for the first embodiment of the head band device 32. The head band device 32 is preferably worn above the eyes 38 to collect perspiration 34 and channel it away from the wearer's eyes 38, and may be placed either above the ears 56, as shown, or over the wearer's ears 56, which is not shown. FIG. 2 shows the side view of the first embodiment of the head band device 32 as it may be worn on the wearer's head 36. FIG. 3 is perspective view of the first embodiment. FIG. 4 is an enlarged view illustrating the draining effect of the sloping gutter structure 48 at the first side 44 of the head band device 32 from FIG. 2. FIG. 5 is a front view showing a front portion 42 of the head band device 32. FIG. 6 is a top view of the first embodiment shown in FIG. 1 as taken along line 6-6.

As shown in FIGS. 3 and 5, the gutter structure 48 is continuous as it extends, beginning from the first side band portion 44, entirely along the front band portion 42 and terminating to the second side band portion 46. As shown in FIG. 6, the gutter structure 48, comprised of the gutter base 58 and gutter lip 60, extends from the outer surface of the front and side band portions 42, 44, 46. As shown in FIGS. 5-7C, the top edge 62 of the front band portion 42, the first side band portion 44, and the second side band portion 46 is sloped downward towards the gutter structure 48 to promote drainage into the perspiration channel 64. The perspiration channel 64 is made of non-absorbent material in the first embodiment, however in other embodiments; the perspiration channel 64 may have absorbent material added into a portion or the entirety of the channel 64.

Figure 7C:
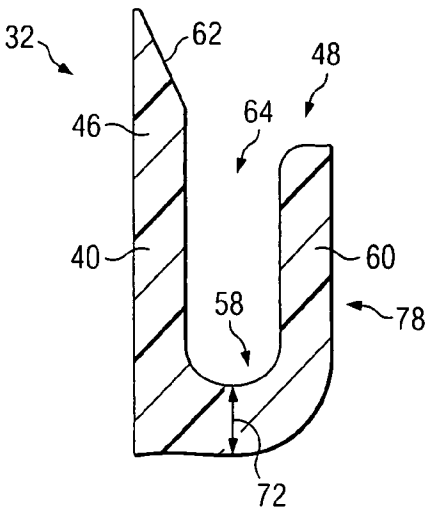
FIGS. 7A-7C are cross-section views taken from FIG. 6.
Figure 7B:
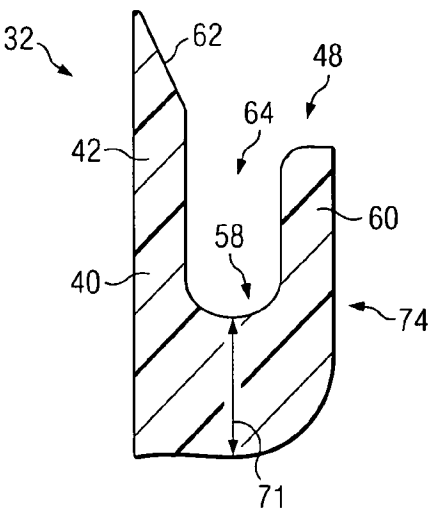

As shown in FIG. 5, the gutter base 58 has a first thickness 71 that is greater at the center portion 74 of the gutter structure 48, which is also illustrated in the cross-section view of FIG. 7B. The thickness of the gutter base 58 decreases from the center portion 74 along the perspiration channel 64 to a second thickness 72 at the first outer lip edge 76, shown also in the cross-section view of FIG. 7A. Likewise, the thickness of the gutter base 58 decreases from the center portion 74, shown in FIG. 7B, to a second thickness 72 at the second outer lip edge 78, shown in the cross-section view of FIG. 7C. The decrease in gutter base thickness from the center section 74 of the perspiration channel 64 to the first outer lip edge 76 and the second outer lip edge 78 causes the gutter base 58 to slop downwards and allows perspiration 34 to drain out of the perspiration channel 64 more efficiently. In other embodiments, the gutter structure 48 may have the same thickness at the center portion 74 of the gutter structure 48 as the thickness at the first outer lip edge 76 and the second outer lip edge 78 of the gutter structure 48. Although the gutter structure 48 has been shown in this preferred embodiment with a band that has a sloped top edge 62 and with a closure system 54 having hook-and-loop fasteners 81, 82 and an elastic loop member 84, in other embodiments (not shown) the gutter structure 48 of FIGS. 5-8 may be combined with any suitable band design and/or any suitable closure system.

Figure 8:
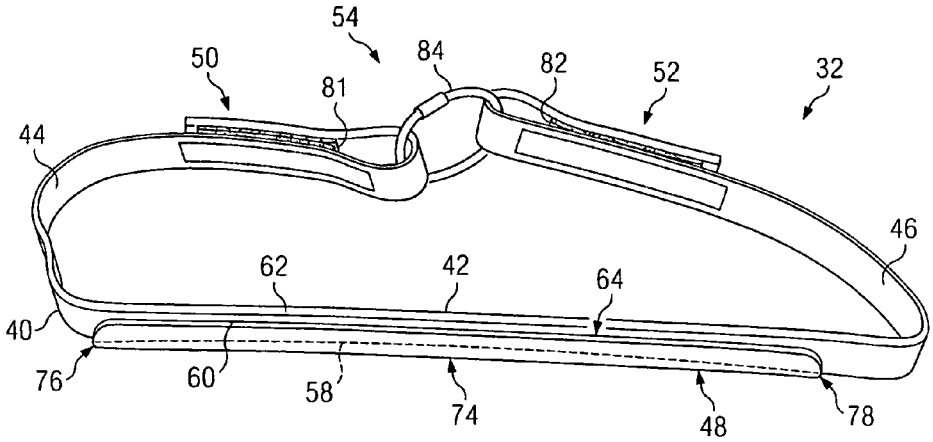
FIGS. 8 and 9 show the closure system of the first embodiment of the present invention.
Figure 9:
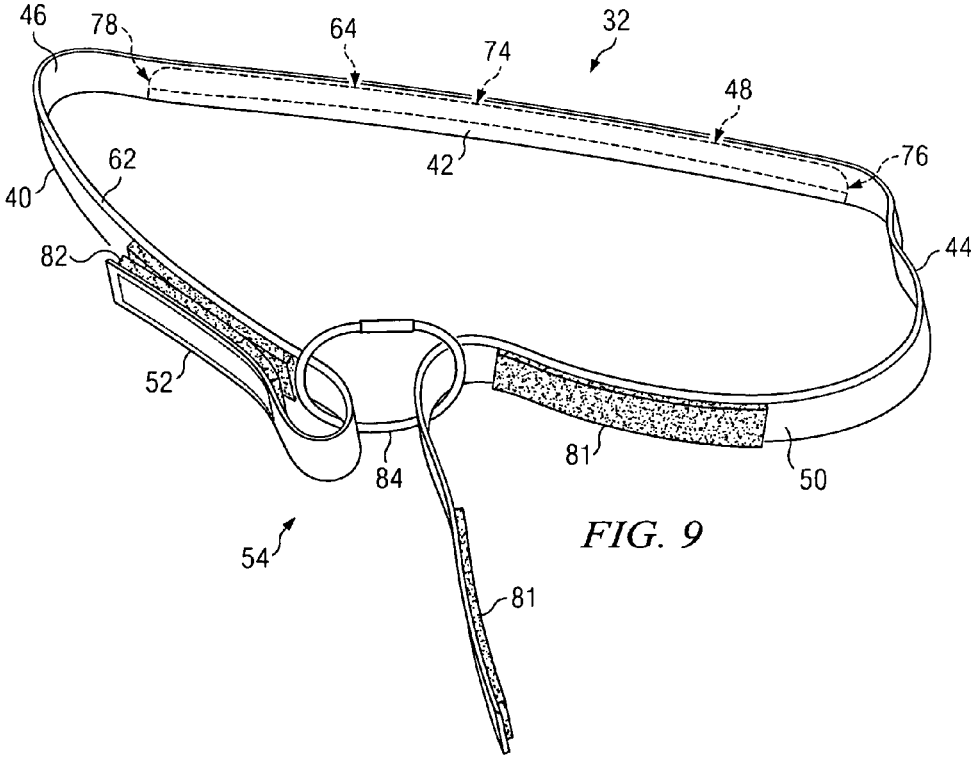

As shown in FIGS. 8 and 9, the closure system 54 of the first embodiment of the present invention includes an elastic loop member 84, a first hook-and-loop fastener 81, and a second hook-and-loop fastener 82. The first hook-and-loop fastener 81 is attached to the first rear band portion 50 so that the first rear band portion 50 is folded onto itself with the elastic loop member 84 threaded through the fastener 81 to form a closed configuration. The second hook-and-loop fastener 82 is attached to the second rear band portion 52 so that the second rear band portion 52 is folded onto itself with the elastic loop member 84 threaded through the fastener 82 to form a closed configuration. The hook-and-loop fastener members 81, 82 may be sewn onto the band using any suitable thread material, including (but not limited to): cotton, nylon, polyester, fluorocarbon, monofilament, and combinations thereof, for example. In other embodiments, the fastener member may include (but is not limited to): a loop portion of a hook-and-loop fastener, a hook portion of a hook-and-loop fastener, a snap, a clasp, a button, a button hole, a zipper, a latch, a buckle, a buckle hole, a clip, a magnet, a screw, a bolt, a nut, or combinations thereof, for example. In a preferred embodiment, the head band device 32 is provided to the customer with different size elastic loop members 84 (e.g., three different diameters). This provides users with a variety of sizing options and flexibility options for the head band device 32. Adding a flexible closure system 54 allows the wearer to custom fit the head band device 32 for optimum comfort and easy adjustment to fit the wearer's head. Although the closure system 54 has been shown in this preferred embodiment with a band 40 that has a sloped top edge 62 and with a gutter structure 48 having a sloped gutter bottom 58, in other embodiments (not shown) the closure system 54 of FIGS. 8-9 may be combined with any suitable band design and/or any suitable gutter structure, such as those with a sloped base and those without a sloped base.

To use the first embodiment of the head band device 32, the first hook-and-loop fastener 81 is threaded through the elastic loop member 84 and closed, and the second hook-and-loop fastener 82 is threaded through the elastic loop member 84 and closed (before or after being placed on the wearer's head). The front band portion 42 is placed on the wearer's head 36 positioned above the wearer's eyes 38, as shown in FIG. 1. As the wearer exerts energy and perspiration 34 begins to form on the forehead area 36 and fall, the perspiration 34 will flow down from the wearer's head 36 to the device 32, flowing over the sloped top edge 62 and down into the perspiration channel 64. Due to the sloping gutter structure 48, the perspiration 34 will flow to the ends of the gutter structure 48 and drain out the open drain ends 76, 78, as shown in FIG. 4. When worn, this device 32 protects the wearer's eyes 38 by channeling liquids and other materials away from a wearer's eyes 38. Additionally, by being made of non-absorbent material, it allows the wearer to focus on the task at hand rather than have the need to stop and wring out a traditional absorbent head band or stop and wipe liquids off his/her forehead, to prevent drainage into his/her eyes. The specific addition of a sloping gutter structure 48 to an embodiment allows sweat to drain efficiently, even when the user's head is substantially stationary, the user is in a slightly bent position, or the user is in an awkward position.

As shown in FIGS. 10-12, the first embodiment of the head band device 32 may be worn with or without additional headwear such as (but not limited to): a helmet 86, a hat, eyewear, a face shield, any protective headwear, or any other headwear or eyewear, for example. The first embodiment of the present invention may be used in many different sports and activities, including (but not limited to): basketball, bicycling, soccer, volleyball, football, running, walking, aerobics, martial arts, baseball, softball, hockey, yoga, tennis, racquetball, hiking, kayaking, skating, and many more, for example. FIG. 12 shows another use for an embodiment of the head band device 32. Any laborers, such as construction workers, factory workers, plumbers, carpenters, lawn care workers, farmers, and many others, may find great benefit to wearing the device. An embodiment of the present invention may also be used by military, police, firefighters, paramedics, or any other public service position requiring rigorous activity or activity in hot environments, where it would be desirable to keep sweat out of one's eyes while working.

Figure 13:
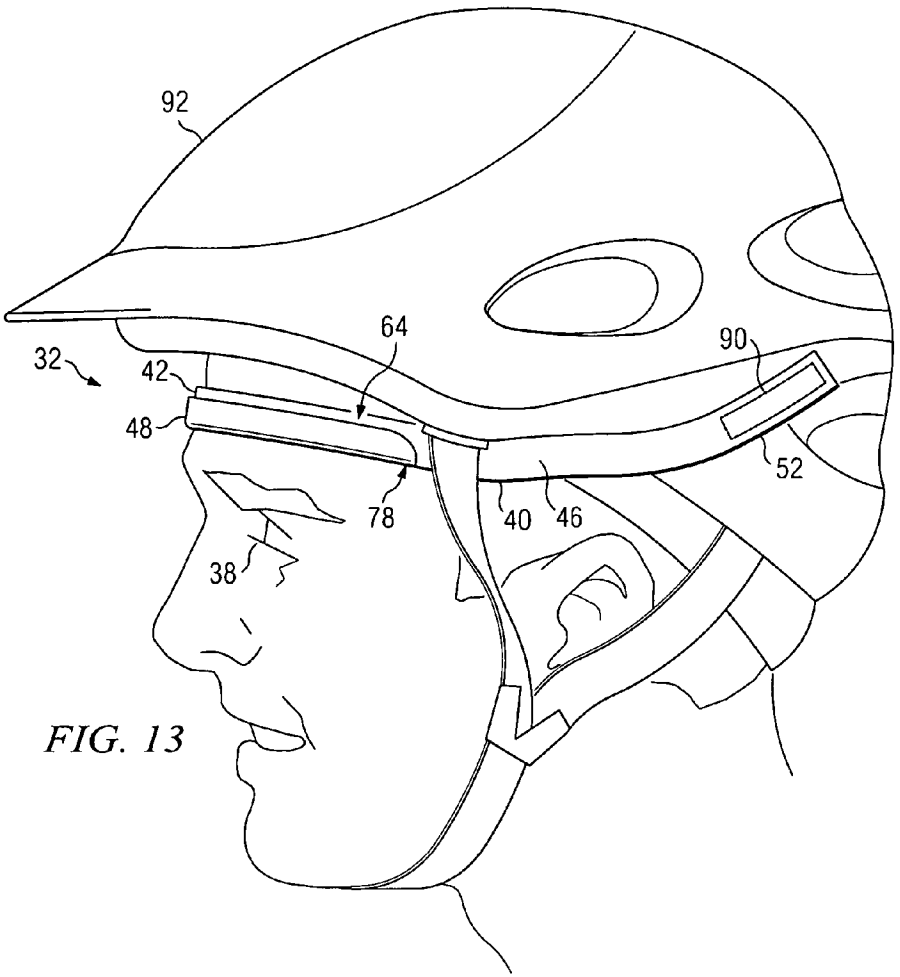

FIG. 13 shows a head band device 32 in accordance with a second illustrative embodiment of the present invention. In this embodiment, a first fastener is attached to the first rear band portion and a second fastener 90 is attached to the second rear band portion 52 (first rear band portion not shown in FIG. 13 because on other side of user's head, mirror symmetrically opposed). The first and second fasteners are configured to be interchangeably attached to head wear, including (but not limited to): a hat, a helmet, eyewear, a face shield, any protective headwear, or any other headwear or eyewear, or any combination thereof, for example. The first and/or second fasteners may be permanent, temporary, or removable fasteners, for example. In another embodiment (not shown), a head band device 32 of the present invention may be fully integrated into any hat, helmet, eyewear, face shield, protective headwear, other headwear, or other eyewear, for example. As another illustrative embodiment (not shown), a head band device 32 of an embodiment may be integral to or attached to a helmet liner. In yet another embodiment (not shown), a head band device 32 of the present invention may be fully integrated into, permanently attached to, temporarily attached to, or removably attached to another head band, such as a conventional terrycloth sweatband, a dew rag, a leather headband, or a hemp headband, for example.

In FIG. 13, the head band device 32 is shown attached to a bicycling helmet 92 using hook-and-loop fasteners, for example. The fastener member 90 used to attach the head band device 32 of the second embodiment to head wear 92 may be any suitable fastener, including (but not limited to): a loop portion of a hook-and-loop fastener, a hook portion of a hook-and-loop fastener, a snap, a clasp, a button, a button hole, a zipper, a latch, a buckle, a buckle hole, a clip, a magnet, a screw, a bolt, a nut, or combinations thereof, for example. Also in this second embodiment, the gutter structure 48 may have any suitable configuration: with or without a sloped top edge 62; and/or with or without a sloped gutter base 58. Many users may find it beneficial to have a head band device 32 with a flexible closure system 54 that incorporates into their previously chosen head wear. Any existing head wear may be adapted for use with an embodiment of the present invention.

Figure 14:
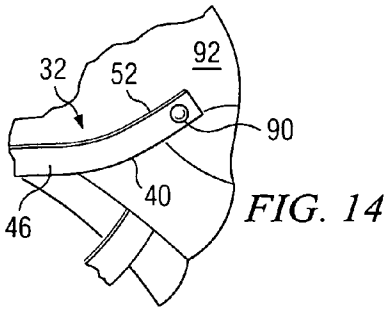
FIGS. 13-16 show a second illustrative embodiment of the present invention.
Figure 15:
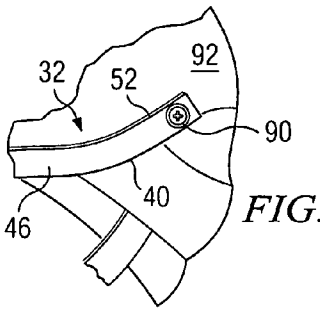
Figure 16:
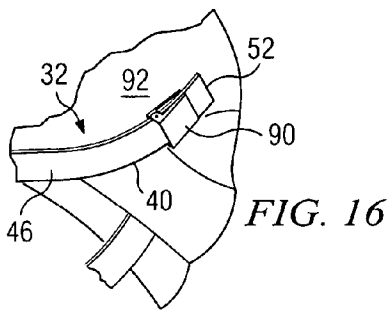

FIGS. 14-16 show some illustrative embodiment variations on the second embodiment. The embodiments shown in FIGS. 14-16 are essentially the same as the second embodiment of FIG. 13, except that the fastener members differ. In FIG. 14, the fastener member is a snap fastener 90. In FIG. 15, the fastener member is a screw 90. And in FIG. 16, the fastener member is a clasp fastener 90. Hence, FIGS. 14-16 show just a few possible fastener members that may be implemented in the second embodiment of the present invention to form other embodiments. Such variations on the second embodiment may have a gutter structure 48 with any suitable configuration: with or without a sloped top edge 62; and/or with or without a sloped gutter base 58.

Figure 17:
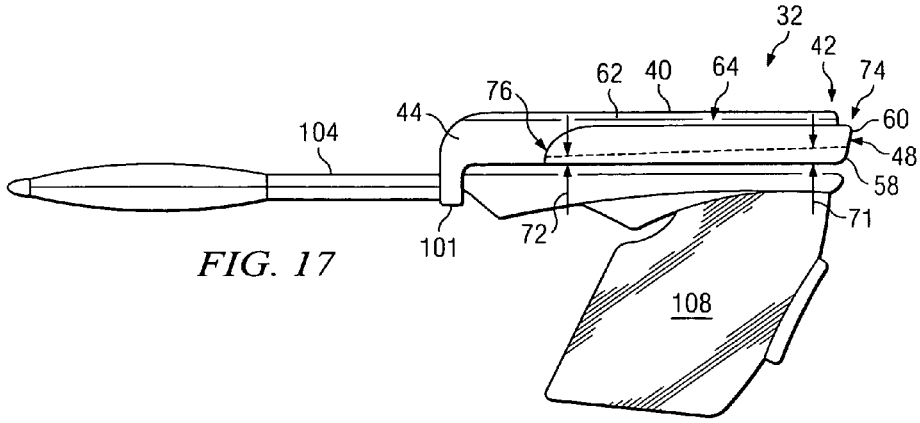
FIGS. 17-18 show a third illustrative embodiment of the present invention.
Figure 18:
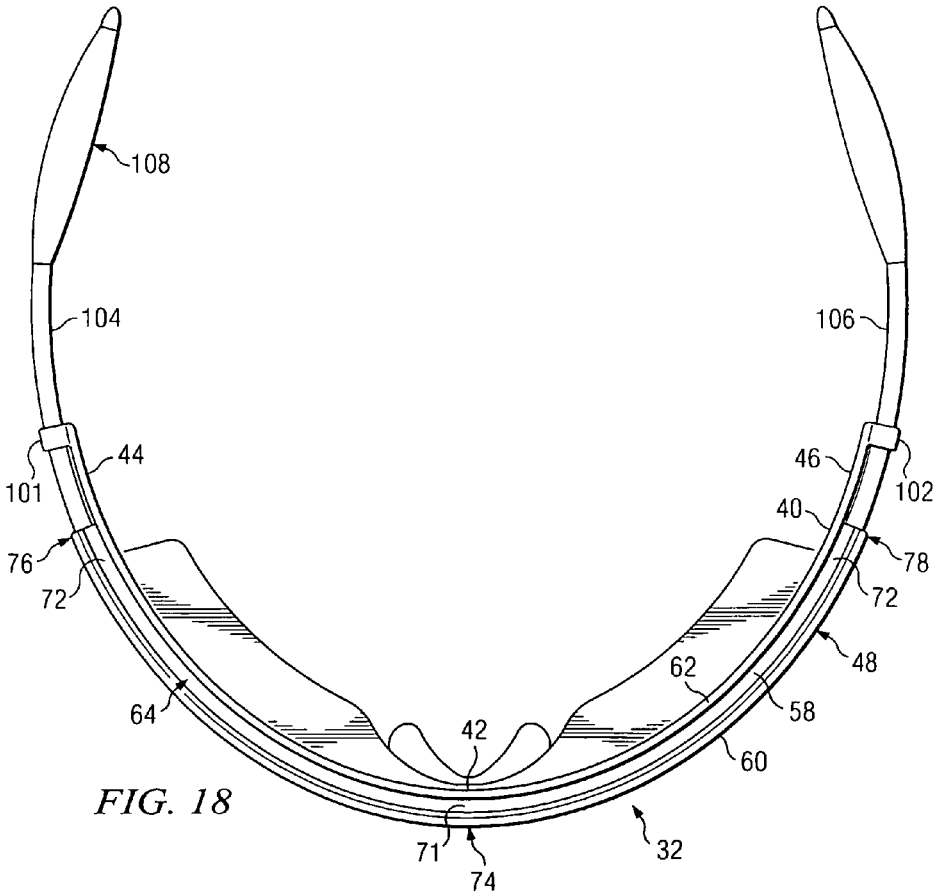

FIGS. 17-18 show a head band device 32 in accordance with a third illustrative embodiment of the present invention. In this embodiment, the first side band portion 44 and the second side band portion 46 may be formed with an integral loop portion 101, 102 acting as a fastener member. In other words, the fastener member 101, 102 of the third embodiment is an oval or circular loop portion that is an integrated portion of the device. This integrated loop portion allows a wearer to slide a first side portion 104 and a second side portion 106 of his/her eyewear 108 through the first loop portion 101 of the first side band 44 and the second loop portion 102 of the second side band 46, respectively, as shown in FIG. 18. In the third embodiment, the fastener member 101, 102 may be made of the same material as the other portions of the head band device 32. Alternatively, the fastener member 101, 102 may be constructed as a separate piece and attached to the side band portions 44, 46 of the head band device 32. As yet another illustrative alternative, the fastener member 101, 102 may be configured to fold around the eyewear 108 as a loop on each side to create a closed configuration around the first side frame 104 of the eyewear 108 and the second side frame 106 of the eyewear 108. The fastener member 101, 102 of the third embodiment may be any suitable fastener, including (but not limited to): a loop portion of a hook-and-loop fastener, a hook portion of a hook-and-loop fastener, a snap, a clasp, a button, a button hole, a zipper, a latch, a buckle, a buckle hole, a clip, a magnet, a screw, a bolt, a nut, or combinations thereof, for example. In variations of the third embodiment, the head band device 32 may have a gutter structure 48 with any suitable configuration: with or without a sloped top edge 62; and/or with or without a sloped gutter base 58.

Figure 19:
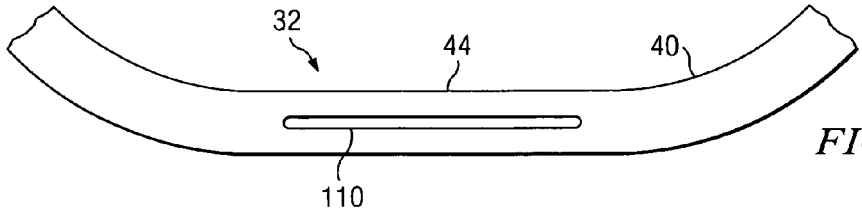
FIGS. 19-20 show hole features that may be added to any embodiment of the present invention.
Figure 20:
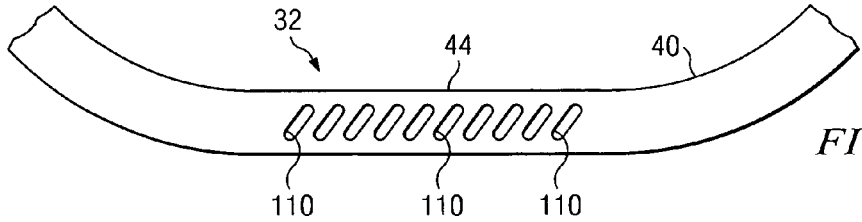

FIGS. 19-20 show a feature that may be added to any embodiment of the present invention, including (but not limited to): those with or without a sloped top edge 62; those with or without a sloping gutter structure 48; those with any closure or fastener system 54; and combinations thereof. The hole features 110 shown in FIGS. 19-20 are formed in the first side band portion 44 and the second side band portion (not shown) of the head band device 32. An embodiment of the head band device 32 may have a single hole 110, as shown in FIG. 19, or multiple holes 110 as shown in FIG. 20. The hole or holes 110 may be oval shaped, as shown, but also may have any suitable shape including (but not limited to) being round, oval, rounded, trapezoidal, hexagonal, pentagonal, square, rectangular, or combinations thereof, for example. The holes 110 allow for several benefits that may appeal to some users of the device 32. The addition of a single or multiple holes 110 in the side portions 44, 46 of the band 40 allows for additional flexibility in the band 40. Additionally, single or multiple holes 110 may allow for greater heat disbursement for the wearer. Some wearers prefer to wear the side band portions 44, 46 of an embodiment of the head band device 32 over their ears and the addition of holes 110 may be found to be more comfortable for them.

Figure 21:
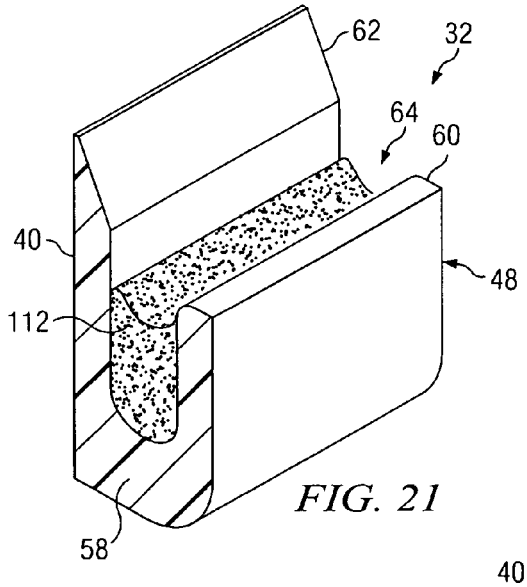
FIGS. 21-30 show an additional feature of absorbent material attached to the gutter structure, which may be added to any embodiment of the present invention.
Figure 22:
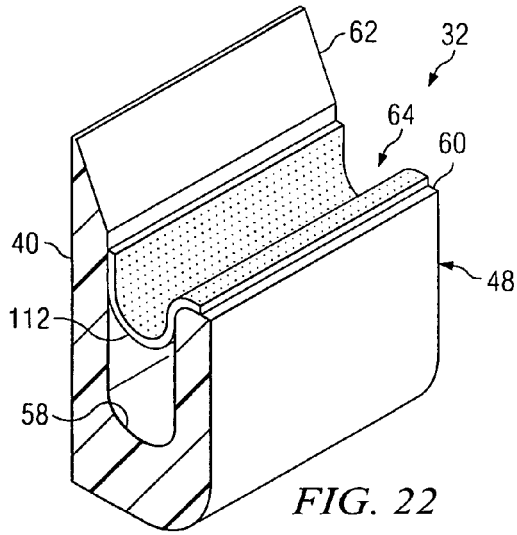
Figure 23:
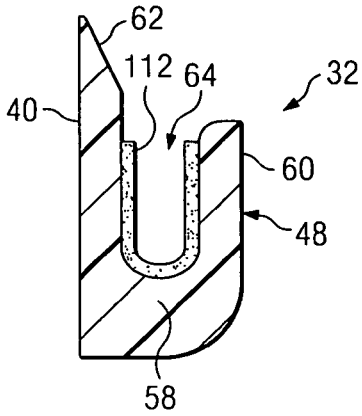
Figure 24:
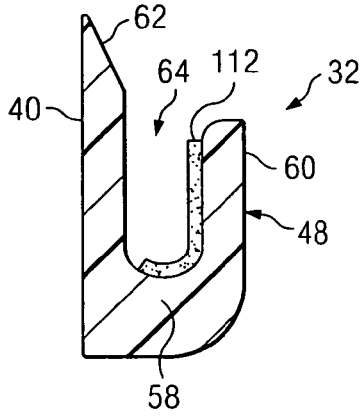
Figure 25:
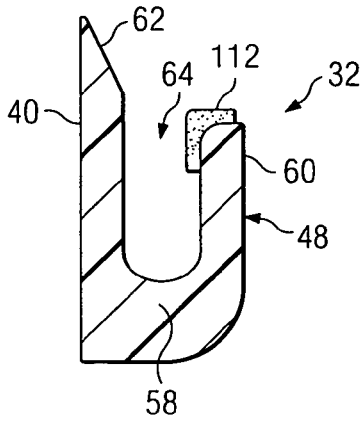
Figure 26:
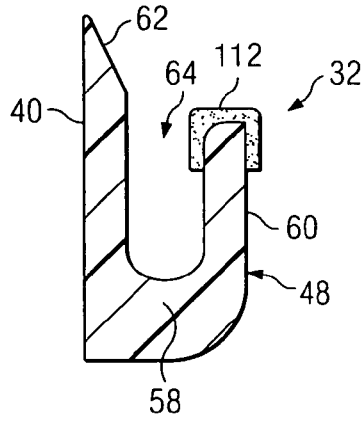
Figure 27:
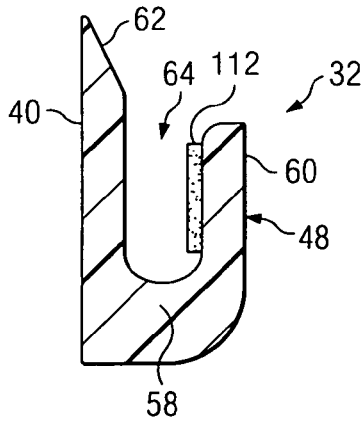
Figure 28:
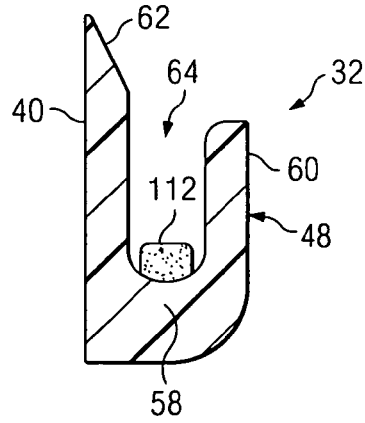
Figure 29:
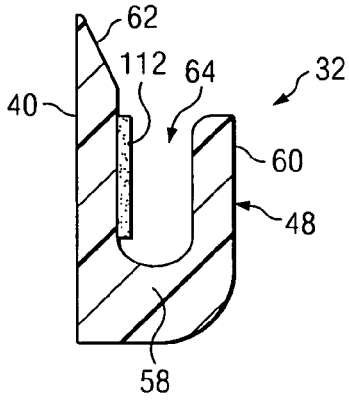
Figure 30:
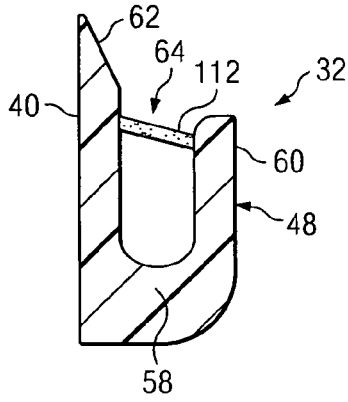

FIGS. 21-30 show an additional feature of absorbent material 112 attached to the gutter structure 48 and located partially in and/or over the perspiration channel 64. This additional absorbent material 112 may be added to any embodiment of the present invention, including (but not limited to): those with or without a sloped top edge 62; those with or without a sloping gutter structure 48; those with any closure or fastener system 54; or combinations thereof. The absorbent material 112 may be made of any suitable material, including (but not limited to): cotton, wicking material, lycra, Lastex™, Gortex™, polyester, rayon, natural sponge, artificial sponge, or any combination of these materials, for example. The absorbent material 112 may be used to prevent or hinder perspiration 34 in the gutter structure 48 from splashing or spilling out of the perspiration channel 62 in situations in which the wearer may be leaning forward or turning his/her head quickly or other vigorous activities. The material 112 may cover a portion or the entirety of the perspiration channel 62. In other words, the material may extend entirely throughout the channel 62 or only partially through/along the channel 62. The additional absorbent material 112 may be one piece of material or multiple pieces. The absorbent material 112 may be fitted fully into the gutter structure 48, as shown in the cross-section of FIG. 21, or may be fixed towards the top of the gutter structure 48 as illustrated in FIG. 22. The absorbent material of FIG. 21 is a sponge material (natural or artificial), which may be removably or permanently attached to the perspiration channel 62. Additional, as FIG. 22 shows, the material may be a one way material (e.g., Gortex™ or other micro-membrane material), which would allow drainage into the perspiration channel 62 below, but prevent it from flowing back out of the top of the gutter lip 60. The material may be attached at the upper portion of the front band 42 and the upper portion of the gutter lip 60, as shown in FIG. 22. The cross-section views of FIGS. 23-30 show a variety of possible suitable placements of absorbent material 112 in the gutter base 58 or gutter lip 60, but other placements, not shown, may be utilized as well. The material 112 may be attached to the gutter structure 48 in any suitable manner (removably or permanently) such as, but not limited to, being glued, adhered, clipped, bonded, ultrasonically welded, snapped, zip-locked or zippered, for example.

Figure 7A:
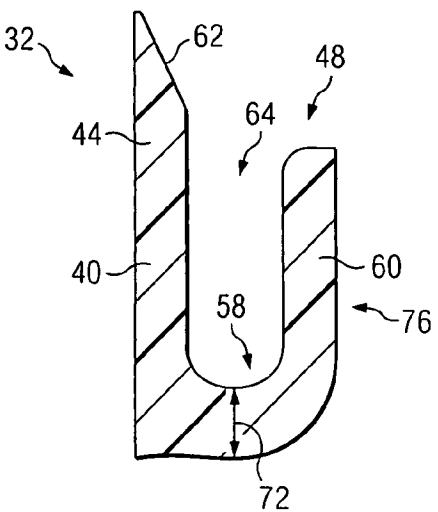
Figure 31A:
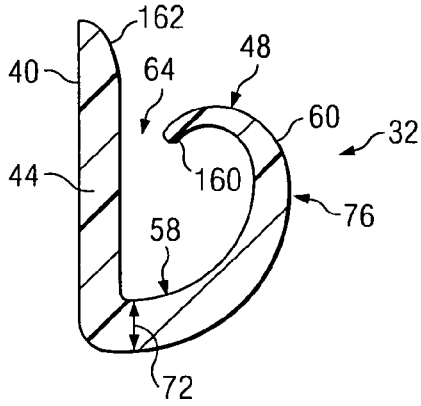
FIGS. 31A and 31B show cross-section views of head band device at the perspiration channel for a fourth illustrative embodiment of the present invention.
Figure 31B:
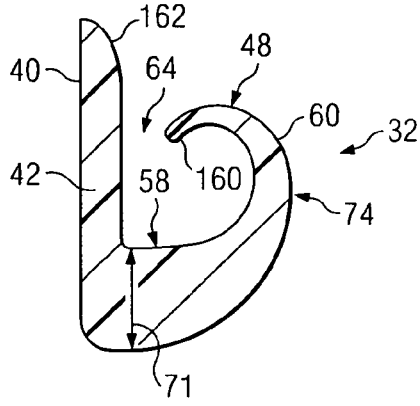

FIGS. 31A and 31B show cross-section views of head band device 32 at the perspiration channel 64 for a fourth illustrative embodiment of the present invention. FIG. 31A shows a cross-section view of the head band device 32 as taken at a first outer lip edge 76 (as FIG. 7A is taken along line 7A-7A in FIG. 6). Similarly, FIG. 31B shows a cross-section view of the head band device 32 as taken at a center portion 74 (as FIG. 7B is taken along line 7B-7B in FIG. 6). In FIGS. 31A and 31B, note that the gutter base 58 has a first thickness 71 at the center portion 74, which is greater than a second thickness 72 of the gutter base 58 at the first outer lip edge 76. Thus, the perspiration channel 64 has a sloping gutter base 58 in the fourth embodiment. In the fourth embodiment, the gutter lip 60 has a terminal portion 160 pointing towards the band 40, as shown in FIGS. 31A and 31B. In other words, the gutter lip 60 curves toward the outer surface of the band 40. Also in the fourth embodiment, the top edge 162 of the band 40, at least above the gutter structure 48, is curved downward toward the gutter structure 48 (see FIGS. 31A and 31B). Any of these features of the fourth embodiment (i.e., the gutter lip 60 curved toward the band 40 and/or the top edge 162 curved downward toward the gutter structure 48) may be incorporated into another embodiment of the present invention to create other variations of the present invention.

Figure 32A:
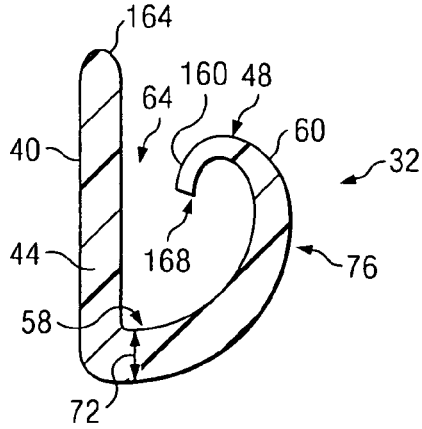
FIGS. 32A and 32B show cross-section views of head band device at the perspiration channel for a fifth illustrative embodiment of the present invention.
Figure 32B:
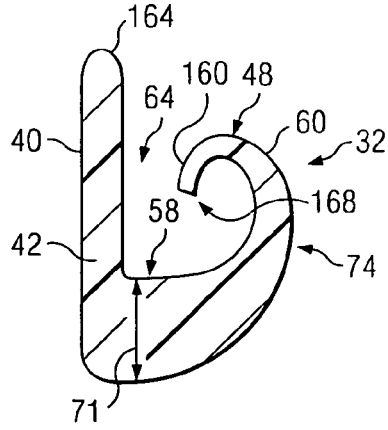

FIGS. 32A and 32B show cross-section views of head band device 32 at the perspiration channel 64 for a fifth illustrative embodiment of the present invention. FIG. 32A shows a cross-section view of the head band device 32 as taken at a first outer lip edge 76 (as FIG. 7A is taken along line 7A-7A in FIG. 6). Similarly, FIG. 32B shows a cross-section view of the head band device 32 as taken at a center portion 74 (as FIG. 7B is taken along line 7B-7B in FIG. 6). In FIGS. 32A and 32B, note that the gutter base 58 has a first thickness 71 at the center portion 74, which is greater than a second thickness 72 of the gutter base 58 at the first outer lip edge 76. Thus, the perspiration channel 64 has a sloping gutter base 58 in the fifth embodiment. In the fifth embodiment, the gutter lip 60 has a terminal portion 160 pointing downward towards the gutter base 58, as shown in FIGS. 32A and 32B. In other words, the gutter lip 60 toward the outer surface of the band 40 and then downward toward the gutter base 58. Also in the fifth embodiment, note that the gutter lip 60 terminates with a non-rounded inner edge 168. This sharp edge 168 will cause perspiration urged forward to shed off of the gutter lip 60 downward toward the gutter base 58. Having a rounded tip on a gutter lip 60 may allow the perspiration to roll over the rounded tip. Furthermore in the fifth embodiment, the top edge 164 of the band 40, at least above the gutter structure 48, has a generally rounded cross-section shape (see FIGS. 32A and 32B). Any of these features of the fifth embodiment (i.e., the gutter lip 60 curved toward the gutter base 58, the sharp edge 168, the top edge 164 being rounded, or any combinations thereof) may be incorporated into another embodiment of the present invention to create other variations of the present invention.

An embodiment of the present invention may provide one or more of the following advantages:

- Providing protection for the wearer's eyes from liquid and liquefied materials such as perspiration, sunscreen, and makeup from flowing into the wearer's eyes;
- Providing the user the ability to focus on the task at hand by not needing to stop their current task to wring out a traditional absorbent head band;
- Providing the user the ability to focus on the task at hand by not having to stop to wipe liquids off his/her forehead;
- Providing a flexible closure system which allows the user to custom fit the head band device for optimum comfort, easy adjustment, and eye protection;
- Providing a flexible closure system that may attach to and be incorporated into other head wear devices;

Providing a sloping gutter that allows sweat to still drain efficiently, even when the user is in a slightly bent or awkward position;

Providing additional flexibility and comfort for the wearer of the device by the addition of one or more holes on the side band portions of the device;

Providing holes that may allow for more efficient heat disbursement from the wearer's head.

Although embodiments of the present invention and at least some of its advantages have been described in detail, it should be understood that various changes, substitutions, and alterations may be made herein without departing from the spirit and scope of the invention as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A head band device for protecting a wearer's eyes from perspiration from the wearer's forehead, comprising:

a substantially nonabsorbent band comprising a front band portion, a first side band portion, and a second side band portion; and a gutter structure extending from an outer surface of the band, the gutter structure comprising a gutter base and a gutter lip, the gutter base and the gutter lip being substantially nonabsorbent, the gutter structure in combination with the front band portion and at least part of the first and second side band portions forming a perspiration channel with a generally U-shaped cross-section, the gutter structure being continuous as it extends beginning from the first side band portion, entirely along the front band portion, and terminating to the second side band portion, the gutter base having a first thickness at a central portion thereof, and the gutter base having a second thickness at end portions thereof, wherein the first thickness is greater than the second thickness, and wherein the gutter base slopes from the central portion downward toward the end portions thereof, transitioning from the first thickness to the second thickness.

2. The head band device of claim 1, wherein the gutter base and the gutter lip are integrally formed with the band from a same PVC material.

3. The head band device of claim 1, wherein a top edge of the band, at least above the gutter structure, is sloped downward toward the gutter structure.

4. The head band device of claim 1, wherein the band further comprises a first rear band portion and a second rear band portion; and wherein the head band device further comprises a closure system, the closure system comprising an elastic loop member, a first hook-and-loop fastener, and a second hook-and-loop fastener, the first hook-and-loop fastener being attached to the first rear band portion, such that the first rear band portion is folded on itself with the first hook-and-loop fastener located there between when the first hook-and-loop fastener is in a closed configuration, the second hook-and-loop fastener being attached to the second rear band portion, such that the second rear band portion is folded on itself with the second hook-and-loop fastener located there between when the second hook-and-loop fastener is in a closed configuration, in an operable configuration, the first rear band portion being threaded through the elastic loop member when the first hook-and-loop fastener is in its closed configuration, in the operable configuration, the second rear band portion also being threaded through the elastic loop member when the second hook-and-loop fastener is in its closed configuration, and in the operable configuration, the band forms a loop structure via the elastic loop member.

5. The head band device of claim 1, further comprising:

a first fastener attached to an end region of the first side band portion; and a second fastener attached to an end region of the second side band portion, wherein the first and second fasteners are configured to removably attach to a hat, a helmet, eyewear, or any combination thereof in an interchangeable manner.

6. The head band device of claim 1, wherein each of the side band portions has one or more holes formed therein, the holes being located at a spaced distance from the gutter structure along the band.

7. The head band device of claim 1, further comprising an absorbent material attached to the gutter structure and located at least partially in and/or over the perspiration channel.

8. The head band device of claim 1, wherein the gutter lip curves toward the outer surface of the band.

9. The head band device of claim 1, wherein the gutter lip curves toward the outer surface of the band and then downward toward the gutter base.

10. The head band device of claim 9, wherein the gutter lip terminates with a non-rounded inner edge.

11. The head band device of claim 1, wherein a top edge of the band, at least above the gutter structure, is curved downward toward the gutter structure.

12. The head band device of claim 1, wherein a top edge of the band, at least above the gutter structure, has a generally rounded cross-section shape.

13. A head band device for protecting a wearer's eyes from perspiration from the wearer's forehead, comprising:

a substantially nonabsorbent band comprising a front band portion, a first side band portion, a second side band portion, a first rear band portion, and a second rear band portion;

a gutter structure extending from an outer surface of the band, the gutter structure comprising a gutter base and a gutter lip, the gutter base and the gutter lip being substantially nonabsorbent, the gutter structure in combination with the front band portion and at least part of the first and second side band portions forming a perspiration channel with a generally U-shaped cross-section, and the gutter structure being continuous as it extends beginning from the first side band portion, entirely along the front band portion, and terminating to the second side band portion; and a closure system comprising an elastic loop member, a first hook-and-loop fastener, and a second hook-and-loop fastener, the first hook-and-loop fastener being attached to the first rear band portion, such that the first rear band portion is folded on itself with the first hook-and-loop fastener located there between when the first hook-and-loop fastener is in a closed configuration, the second hook-and-loop fastener being attached to the second rear band portion, such that the second rear band portion is folded on itself with the second hook-and-loop fastener located there between when the second hook-and-loop fastener is in a closed configuration, in an operable configuration, the first rear band portion being threaded through the elastic loop member when the first hook-and-loop fastener is in its closed configuration, in the operable configuration, the second rear band portion also being threaded through the elastic loop member when the second hook-and-loop fastener is in its closed configuration, and in the operable configuration, the band forms a loop structure via the elastic loop member, wherein the gutter base has a first thickness at a central portion thereof and a second thickness at end portions thereof, the first thickness being greater than the second thickness, and wherein the gutter base slopes from the central portion downward toward the end portions thereof, transitioning from the first thickness to the second thickness.

14. The head band device of claim 13, wherein the gutter base and the gutter lip are integrally formed with the band from a same PVC material.

15. The head band device of claim 13, wherein a top edge of the band, at least above the gutter structure, is sloped downward toward the gutter structure.

16. The head band device of claim 13, wherein each of the side band portions has one or more holes formed therein, the holes being located at a spaced distance from the gutter structure along the band.

17. The head band device of claim 13, further comprising an absorbent material attached to the gutter structure and located at least partially in and/or over the perspiration channel.

18. A head band device for protecting a wearer's eyes from perspiration from the wearer's forehead, comprising:

a substantially imperforate and nonabsorbent band comprising a front band portion, a first side band portion, and a second side band portion; and a gutter structure extending from an outer surface of the band, the gutter structure comprising a gutter base and a gutter lip, the gutter base and the gutter lip being substantially imperforate and nonabsorbent, the gutter structure in combination with the front band portion and at least part of the first and second side band portions forming a perspiration channel with a generally U-shaped cross-section, the gutter structure being continuous as it extends beginning from the first side band portion, entirely along the front band portion, and terminating to the second side band portion, a first fastener attached to an end region of the first side band portion; and a second fastener attached to an end region of the second side band portion, wherein the first and second fasteners are configured to removably attach to a hat, a helmet, eyewear, or any combination thereof in an interchangeable manner, wherein the gutter base has a first thickness at a central portion thereof and a second thickness at end portions thereof, the first thickness being greater than the second thickness, and wherein the gutter base slopes from the central portion downward toward the end portions thereof, transitioning from the first thickness to the second thickness.

19. The head band device of claim 18, wherein the gutter base and the gutter lip are integrally formed with the band from a same PVC material.

20. The head band device of claim 18, wherein a top edge of the band, at least above the gutter structure, is sloped downward toward the gutter structure.

21. The head band device of claim 18, wherein each of the side band portions has one or more holes formed therein, the holes being located at a spaced distance from the gutter structure along the band.

22. The head band device of claim 18, further comprising an absorbent material attached to the gutter structure and located at least partially in and/or over the perspiration channel.

23. The head band device of claim 18, wherein the first and second fasteners comprise a fastener member selected from the group consisting of a loop portion of a hook-and-loop fastener, a hook portion of a hook-and-loop fastener, a snap, a clasp, a button, a button hole, a zipper, a latch, a buckle, a buckle hole, a clip, a magnet, a screw, a bolt, a nut, and combinations thereof.

* * * * *